US005113923A

United States Patent [19]

White et al.

[11] Patent Number: 5,113,923

[45] Date of Patent: May 19, 1992

[54] METHOD FOR THE MELTING OF METALS

[75] Inventors: Jack C. White, Albany; Davis E. Traut, Corvallis, both of Oreg.

[73] Assignee: The United States of America, as represented by the Secretary of the Interior, Washington, D.C.

[21] Appl. No.: 618,196

[22] Filed: Nov. 23, 1990

[51] Int. Cl.[5] ..... B22D 2/00

[52] U.S. Cl. ..... 164/41; 164/451

[58] Field of Search ..... 164/4.1, 458, 150, 451; 376/392, 394, 393

[56] References Cited

U.S. PATENT DOCUMENTS 3,617,747 11/1971 Wilkinson ..... 164/4.1
4,125,144 11/1978 Kawamoto et al. ..... 164/4.1

FOREIGN PATENT DOCUMENTS 204854 12/1986 European Pat. Off. ..... 164/150
1236831 3/1967 Fed. Rep. of Germany ..... 250/390.04

OTHER PUBLICATIONS

D. Hagemaier, J. Halchak and G. Basl, "Detection of Titanium Hydride by Neutron Radiation", *Natl. Evaluation*, Sep. 1969, p. 193.

N. M. Kochegura, "Investigation and Inspection of the Technological Process of Ingot Production by Means of Radioisotope Method", *Sov. J. Nondestr. Text*, Jan. 1982, p. 395.

*Primary Examiner*—Richard K. Seidel
*Attorney, Agent, or Firm*—E. Philip Koltos

[57] ABSTRACT

A method of quantitatively determining the molten pool configuration in melting of metals. The method includes the steps of introducing hafnium metal seeds into a molten metal pool at intervals to form ingots, neutron activating the ingots and determining the hafnium location by radiometric means. Hafnium possesses exactly the proper metallurgical and radiochemical properties for this use.

5 Claims, No Drawings

METHOD FOR THE MELTING OF METALS

TECHNICAL FIELD

This invention relates to a method of monitoring a metal melting process, and more particularly to a method for determining the molten pool configuration in melting of metals such as titanium, zirconium, and their alloys.

BACKGROUND ART

High speed rotating aircraft parts require high-strength metals such as titanium. Titanium nitride inclusions in titanium and titanium alloy parts lower strength, sometimes with disastrous results. Investigators have searched for the best means during various melting methods, for dissolving titanium nitride inclusions that may cause failure of high-speed, rotating, titanium alloy parts in jet engines. Many studies have been made on the dissolution of titanium nitride in melting of titanium, but none have addressed the fundamental issues of the molten metal pool size and the degree of agitation within the pool. This information is needed to determine which of several melting methods is most likely to dissolve metal nitride inclusions.

Those concerned with these and other problems recognize the need for an improved method for determining the molten pool configuration in melting of metals.

DISCLOSURE OF THE INVENTION

The present invention provides a method of quantitatively determining the molten pool configuration in melting of metals. The method includes the steps of introducing hafnium metal seeds into a molten metal pool at intervals to form ingots, neutron activating the ingots and determining the hafnium location by radiometric means. Hafnium possesses exactly the proper metallurgical and radiochemical properties for this use.

An object of the present invention is the provision of an improved method for determining the molten pool configuration in melting of metals.

Another object is to provide a method that yields information on the fundamental processes occurring during melting of metals, such as titanium and zirconium which has bearing on attempts to eliminate nitride inclusions, which weaken high-technology rotating parts, such as turbine blades and disks.

A further object of the present invention is the provision of a method that generates useful quantitative data on mass transfer within a molten pool of metal.

These and other attributes of the invention will become more clear upon a thorough study of the following description of the best mode for carrying out the invention, particularly when reviewed in conjunction with the examples.

BEST MODE FOR CARRYING OUT THE INVENTION

The following examples are illustrative of the best mode for carrying out the invention. They are obviously not to be construed as limitative of the invention since various other embodiments can readily be evolved in view of the teachings provided herein.

This invention is the result of a fortuitous combination of the properties of the metal hafnium as applied to the specific objective of making a fundamental study of the metal melting process. Hafnium in low concentration forms a solid solution with titanium or zirconium, both of which are elements of the carbon group. The binary phase diagrams show that no hafnium-titanium or hafnium-zirconium separation occurs upon crystallization from the melt, a desirable property for this use. The nuclear properties of hafnium are essential to this invention. Hafnium has a large thermal neutron capture cross section, and $^{181}$hafnium emits two gamma rays of intermediate energy that can be used to detect hafnium at depth and a 0.4 MeV beta that can be used for autoradiography. The $^{181}$hafnium isotope also has a half life of about 42 days, ideal for this application.

EXAMPLE 1

Hafnium metal seeds are introduced into the molten pool at intervals. There the hafnium disperses within the pool. A sharp compositional difference is formed at the solid-liquid interface in the bottom of the pool and along the sides of the pool. The hafnium content of the pool then decreases by successive dilution until another hafnium seed is introduced. In this way, multiple pool configurations can be determined within a single ingot. The compositional differences can be visualized by cutting the ingot lengthwise, machining a smooth surface, activating the specimen with thermal neutrons in a nuclear reactor, and determining the spatial distribution of $^{181}$hafnium by radiometric means such as autoradiography or gamma counting techniques. The beta ray emissions are ideal for radiographic determination of the surface, providing contact prints of hafnium distribution. Gamma rays may be used to determine hafnium content deep within the sample. Interpretation of the resulting data will provide a picture of molten pool geometry and the mass transfer of metal from electrode to pool bottom by the rate of successive dilution. Thus, the various means of melting titanium and hafnium such as vacuum consumable electrode, electroslag, plasma, and electron beam methods could be compared quantitatively.

EXAMPLE II

Typically, in consumable electrode vacuum arc melting, three 2-inch by 2-inch by 10-inch sponge compacts would be made, each containing a 1-gram seed of hafnium sponge in the center of the bar. The three compacts would be welded end-to-end to form a 2-inch by 2-inch by 30-inch electrode for melting into a 4-inch diameter water cooled copper crucible. The ingot so produced would be sliced, machined, neutron activated, and radiometrically analyzed as previously described. Neutron activation can be for lesser or greater periods of time as can radiometric counting and autoradiography. In a preferred embodiment, three 1-gram seeds would be melted into a 4-inch diameter by 8-inch long ingot. Neutron activation for 10 hours and an autoradiograph exposure for 10 days should provide optimum results.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

We claim:

1. A method of quantitatively determining the molten pool configuration in melting of metals, comprising the steps of:

melting solid metal by application of a melting means to form a molten pool of metal to be received in a cooling crucible;

introducing hafnium metal seeds into the molten metal pool at time intervals as the molten pool solidifies to form an ingot;

removing the ingot from the crucible;

neutron activating the ingot; and determining the hafnium location in the ingot by radiometric means.

2. The method of claim 1 wherein said metal forms a solid solution with low concentrations of hafnium.

3. The method of claim 1 wherein said metal does not separate from hafnium upon crystallization from a melt.

4. The method of claim 1 wherein said metal is an element of the carbon group.

5. The method of claim 1 wherein said metal is selected from a group consisting of titanium and zirconium.

* * * * *